United States Patent [19]

Sundt et al.

[11] 4,173,550

[45] Nov. 6, 1979

[54] PERFUMED ARTICLES CONTAINING 3-PHENYL-CYCLOPENT-2-EN-1-ONE

[75] Inventors: Erling Sundt, Vessy; Roland Aschiero, Bernex, both of Switzerland

[73] Assignee: Firmenich SA, Geneva, Switzerland

[21] Appl. No.: 953,916

[22] Filed: Oct. 23, 1978

Related U.S. Application Data

[62] Division of Ser. No. 896,440, Apr. 14, 1978, Pat. No. 4,144,200.

[30] Foreign Application Priority Data

May 6, 1977 [CH] Switzerland ..... 005689/77

[51] Int. Cl.[2] ..... C11B 9/00; C11D 3/50; C11D 9/44

[52] U.S. Cl. ..... 252/522; 252/174.11; 252/108

[58] Field of Search ..... 252/89 R, 108, 522; 260/586 R

[56] References Cited

U.S. PATENT DOCUMENTS 4,144,200 3/1979 Sundt et al. ..... 252/522

*Primary Examiner*—Harris A. Pitlick
*Attorney, Agent, or Firm*—Pennie & Edmonds

[57] ABSTRACT

Method for improving, enhancing or modifying the odoriferous properties of perfumes or perfume products by incorporating therein a cyclopentanone derivative.

2 Claims, No Drawings

PERFUMED ARTICLES CONTAINING 3-PHENYL-CYCLOPENT-2-EN-1-ONE

This is a division, of application Ser. no. 896,440 filed Apr. 14, 1978 now U.S. Pat. No. 4,144,200.

SUMMARY OF THE INVENTION

The invention relates to a method for improving, enhancing or modifying the odoriferous properties of perfumes or perfumed products which method comprises adding thereto an effective amount of 3-phenyl-cyclopent-2-en-1-one, a compound of formula

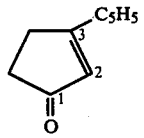

(I)

The invention relates further to a perfume base, a perfume composition or a perfumed article containing as an active ingredient 3-phenyl-cyclopent-2-en-1-one in combination with a support, a perfume coingredient, a diluent or an excipient.

BACKGROUND OF THE INVENTION

Coumarin is a natural constituent of certain plants such as e.g. tonka beans, lavender, woodruff and sweet clover, all vegetable species containing coumarin at a relatively high concentration. This latter possesses a bitter gustative note which modifies itself when said compound is tasted in a diluted state, then becoming sweetish and herbal. Its use in perfumery is rather extensive wherein it is used to support herbaceous odors, such as lavender, lavandin, rosemary and citrus oils and as a fixative in various perfume compositions.

One of the objects of this invention is to replace coumarin with compounds having similar odorous properties which are non-toxic and can be used commercially in the areas where coumarin has previously been used.

We have discovered that certain of the typical odor characters of coumarin could be reproduced by using, as perfume ingredient, a cycloaliphatic unsaturated ketone derivative, namely 3-phenyl-cyclopent-2-en-1-one.

Various compounds possessing an oxo-cyclopentanic structure have been described in the past. Their interest is mainly due to their floral type scent, more particularly to their jasmine-like fragrance. Typical examples of these compounds include cis-jasmone and dihydrojasmone or 3-methyl-2-(pent-cis-2-enyl)-cyclopent-2-en-1-one and 3-methyl-2-pentyl-cyclopent-2-en-1-one, respectively.

THE INVENTION

The compound of the invention, in contradistinction to the above cited analogous derivatives, possesses a spicy, lactonic odor note which is reminiscent of the odor presented by coumarin. Consequently, the use of 3-phenyl-cyclopent-2-en-1-one may enable a partial replacement of this latter compound in numerous perfume compositions, perfume bases and perfumed articles. Due to its stability towards current perfume ingredients, diluents and supports, the compound of the invention can be used in a large variety of applications both in the field of fine perfumery and in the manufacture of technical compositions and cosmetics.

Depending on the nature of the perfumed materials or on the effect desired, the proportions used may vary within a wide range and may be, for example, of the order of about 1 to 10% by weight, based on the total weight of said perfumed materials. Preferred proportions are of about 5%. It has to be understood however that said concentrations are not deemed to represent absolute values and proportions higher or lower than those given above may also be used. Lower concentrations may namely be utilized in the manufacture of perfumed products such as soaps, cosmetics, detergents and house-hold materials in general.

3-Phenyl-cyclopent-2-en-1-one is a known chemical and processes for its preparation have been namely described in Berichte, 17,916 and 2757; idem 41,194 and J.Org.Chem., 36, 698 (1971). Recently, a new synthetic approach has been described by H. Stetter et al. in Synthesis, 379 (1975). However, no mention nor suggestion have been formulated in the above cited references concerning the odorous properties of 3-phenyl-cyclopent-2-en-1-one or its possible use in the field of perfumery.

3-Phenyl-cyclopent-2-en-1-one can also be prepared in accordance with a process which consists in reacting bromo-benzene with 3-ethoxy-cyclopent-2-en-1-one as indicated by the following reaction scheme:

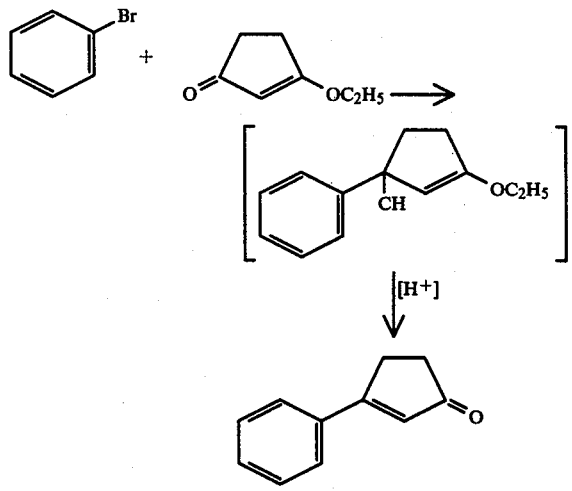

The compound of formula (I), used in conformity with the present invention, is a crystalline solid having a melting point of 81.5°–83° C.; its purification was effected by several successive crystallizations by means of petroleum-ether.

The invention is illustrated in a more detailed manner by the following example.

EXAMPLE

A base perfume composition was prepared by admixing the following ingredients (parts by weight):

| | |
|---|---|
| Lavandin oil | 200 |
| African geranium oil | 100 |
| Cedrene | 80 |
| Oak moss concrete 50%* | 60 |
| Benzyl salicylate | 60 |
| Terpenyl acetate | 60 |
| Linalol | 60 |

-continued

| | |
|---|---|
| Amyl salicylate | 40 |
| Myrcenyl acetate | 40 |
| Synthetic oriental sandalwood | 40 |
| Isobutyl benzoate | 30 |
| Terpineol | 20 |
| 1,1-Dimethyl-4-acetyl-6-ter-butyl-indane | 20 |
| Cyclopentadecanolide | 20 |
| Geraniol | 20 |
| Galbanum resinoid | 10 |
| Patchouli oil | 10 |
| α-iso-Methylionone | 10 |

-continued

| | |
|---|---|
| | 900 |

*in diethylphthalate

By adding to 90 g of the above perfume base 6 g of 3-phenyl-cyclopent-2-en-1-one, there is obtained a novel perfume composition which possessed an improved "fougère" character and a deeper, more tenacious and spicy smell than the base composition.

What we claim is:

1. A method for improving, enhancing or modifying the odoriferous properties of perfumed articles which method comprises adding thereto an effective amount of 3-phenyl-cyclopent-2-en-1-one.

2. A perfumed article containing as an active ingredient 3-phenyl-cyclopent-2-en-1-one in combination with a perfume co-ingredient, or a diluent.

* * * * *